US011298848B1

(12) United States Patent
Clark et al.

(10) Patent No.: US 11,298,848 B1
(45) Date of Patent: Apr. 12, 2022

(54) BULK ROLL CUTTING APPARATUS WITH SAFETY LINKAGE AND RELATED METHODS

(71) Applicant: CORE STRIPPER, INC., Quakertown, PA (US)

(72) Inventors: Eugene Clark, Quakertown, PA (US); Jonathan Mann, Quakertown, PA (US); Scott Davis, Quakertown, PA (US)

(73) Assignee: CORE STRIPPER, INC., Quakertown, PA (US)

( * ) Notice: Subject to any disclaimer, the term of this patent is extended or adjusted under 35 U.S.C. 154(b) by 30 days.

(21) Appl. No.: 16/696,367

(22) Filed: Nov. 26, 2019

Related U.S. Application Data

(60) Provisional application No. 62/795,400, filed on Jan. 22, 2019.

(51) Int. Cl.

| | |
|---|---|
| ***B26D 7/22*** | (2006.01) |
| ***B26D 1/08*** | (2006.01) |
| ***B26D 5/04*** | (2006.01) |
| ***B26D 7/26*** | (2006.01) |

(52) U.S. Cl.
CPC ..... *B26D 7/22* (2013.01); *B26D 1/08* (2013.01); *B26D 5/04* (2013.01); *B26D 7/2628* (2013.01)

(58) Field of Classification Search
CPC ..... B26D 7/22; B26D 7/2628; B26D 1/08; B26D 5/04; B26D 7/26; B23D 15/14; B23D 15/02; B23D 15/12; B23D 35/005
USPC ..... 83/646, 644; 72/389.5, 448, 450, 390.5; 100/35, 259
See application file for complete search history.

(56) References Cited

U.S. PATENT DOCUMENTS 2,087,811 A * 7/1937 Patrick ..... B30B 1/106 100/272
3,245,302 A 4/1966 Bayley ..... 83/614
3,486,407 A * 12/1969 Barnes ..... B21D 5/02 83/630
3,491,643 A * 1/1970 Meinholdt ..... B23D 15/14 83/625
3,616,525 A * 11/1971 Barthel ..... B23D 15/00 29/560
3,866,503 A * 2/1975 Gal ..... B26D 5/18 83/626
3,941,021 A * 3/1976 Meinholdt ..... B23D 17/06 83/604
4,034,666 A * 7/1977 Bigun ..... B30B 1/268 100/231

(Continued)

*Primary Examiner* — Nhat Chieu Q Do
(74) *Attorney, Agent, or Firm* — Hayes Soloway P.C.

(57) ABSTRACT

A bulk roll cutting apparatus with a safety linkage is used to prevent inadvertent gravitational falls of a blade. The apparatus has a frame holding the blade, the blade is movable between a cutting position and a retracted position. In the cutting position, the blade is positioned proximate to an arbor. At least one link arm is movably connected to the frame. An actuator connects between the at least one link arm and the blade. An adjustment device connects between the at least one link arm and the frame. The adjustment device controls a cutting depth of the blade relative to the arbor. A safety linkage connects between the at least one link arm and the frame, and the safety linkage prevents an inadvertent gravitational fall of the blade.

12 Claims, 7 Drawing Sheets

(56) References Cited

U.S. PATENT DOCUMENTS

| | | | | | |
|---|---|---|---|---|---|
| 4,122,740 | A * | 10/1978 | Maltby | B23D 15/08 | 83/646 |
| 4,172,401 | A * | 10/1979 | Terrado Albareda | B23D 35/00 | 83/630 |
| 4,301,723 | A * | 11/1981 | Borzym | B23D 25/04 | 100/271 |
| 4,506,575 | A | 3/1985 | McCay et al. | | 83/368 |
| 4,821,971 | A | 4/1989 | Watanabe et al. | | 242/55 |
| 4,864,906 | A | 9/1989 | Hall | | 83/886 |
| 5,367,930 | A | 11/1994 | Lemley | | 83/368 |
| 5,759,350 | A | 6/1998 | Pyron et al. | | 162/191 |
| 6,142,046 | A | 11/2000 | Mierau et al. | | 83/62.1 |
| 6,761,098 | B1 | 7/2004 | Esping et al. | | 83/102 |
| 6,799,497 | B1 * | 10/2004 | Creighton | B26D 1/08 | 83/630 |
| 7,677,147 | B2 | 3/2010 | Gambini | | 83/102 |
| 8,196,501 | B2 | 6/2012 | Bilskie et al. | | 83/649 |
| 8,424,432 | B2 | 4/2013 | Yu | | 83/423 |
| 8,584,566 | B2 | 11/2013 | Pienta et al. | | 83/614 |
| 2007/0022854 | A1 | 2/2007 | Gambini | | 83/167 |

* cited by examiner

BULK ROLL CUTTING APPARATUS WITH SAFETY LINKAGE AND RELATED METHODS

CROSS REFERENCE TO RELATED APPLICATION

This application claims benefit of U.S. Provisional Application Ser. No. 62/795,400 entitled, "Bulk Roll Cutting Device with Safety Linkage" filed Jan. 22, 2019, the entire disclosure of which is incorporated herein by reference.

FIELD OF THE DISCLOSURE

The present disclosure is generally related to devices for cutting material off bulk roll cores and more particularly is related to a bulk roll cutting device with safety linkage.

BACKGROUND OF THE DISCLOSURE

In the process of manufacturing paper products from bulk paper materials, e.g., with the manufacture of magazines, newspapers, paper-based consumer goods, cardboard, or other paper goods, large rolls of paper are utilized. These rolls are often referred to as bulk rolls and they often consist of the rolled paper material formed over a cardboard core, or a core made from another material. These bulk rolls can weigh a ton or more and can commonly have a length dimension of between 18 inches to 66 inches, although specific weights and dimensions can vary.

During manufacture of the paper product, the paper on the bulk roll is unwound off the core in a continuously operating machine. When the paper on bulk roll is nearing the end of its run, the leading end of a new bulk roll is spliced to the trailing end of the spent roll. This splicing normally occurs quickly and prior to all of the paper on the spent bulk roll actually being consumed. As such, there can often be several layers of remaining paper left on the core of the spent bulk roll. It is desirable to remove these residual layers and reuse the core of the bulk roll, since the core is an expensive structure and it is designed and intended to be reused.

Various devices have been developed to remove the residual layers of the paper from the core, including devices which use a hydraulic piston to move a blade which cuts through the residual layers with a swinging guillotine movement. While these devices are effective, if they're not properly configured for the specific size of the bulk roll—specifically, the size of the core of that bulk roll—the blade of the device can become loose and possibly create a hazardous situation for the machine's operator. In particular, if the blade is not configured properly relative to the core of the bulk roll, when the blade is moved using a hydraulic piston, the arm on the hydraulic piston can become dislodged from a bracket on which it is mounted, which can allow the blade and hydraulic piston assembly to free fall towards the arbor.

Thus, a heretofore unaddressed need exists in the industry to address the aforementioned deficiencies and inadequacies.

SUMMARY OF THE DISCLOSURE

Embodiments of the present disclosure provide an apparatus, system, and related methods for a bulk roll cutting apparatus with safety linkage. Briefly described, in architecture, one embodiment of the system, among others, can be implemented as follows. The bulk roll cutting apparatus with safety linkage has a frame holding a blade. The blade is movable between a cutting position and a retracted position, wherein in the cutting position, the blade is positioned proximate to an arbor. At least one link arm is movably connected to the frame. An actuator is connected between the at least one link arm and the blade. An adjustment device is connected between the at least one link arm and the frame, the adjustment device controlling a cutting depth of the blade relative to the arbor. A safety linkage is connected between the at least one link arm and the frame, the safety linkage preventing an inadvertent gravitational fall of the blade.

The present disclosure can also be viewed as providing an apparatus for removing bulk rolled material from a core. Briefly described, in architecture, one embodiment of the apparatus, among others, can be implemented as follows. The apparatus has a frame having two frame walls, the frame supporting a swing blade movable between a cutting position and a retracted position, wherein in the cutting position, the blade is positioned proximate to an arbor capable of holding a bulk roll. At least one link arm is movably connected to the frame through a first shaft extending between the two frame walls, whereby the at least one link arm is positioned at least partially in a space formed between the two frame walls. An actuator is connected between the at least one link arm and the blade, the actuator positioned at least partially in the space formed between the two frame walls. An adjustment device is connected between the at least one link arm and the frame through a second shaft, the adjustment device being adjustable to control a cutting depth of the blade relative to the arbor. A safety linkage is connected between the at least one link arm and the frame through the second shaft, the safety linkage preventing an inadvertent gravitational fall of the blade.

The present disclosure can also be viewed as providing a method of preventing inadvertent gravitational falls of a blade of an apparatus for removing bulk rolled material from a core. In this regard, one embodiment of such a method, among others, can be broadly summarized by the following steps: providing an apparatus having a frame holding an arbor and a blade, the blade movable between a cutting position and a retracted position, wherein in the cutting position, the blade is positioned proximate to the arbor holding a bulk roll of material with core; controlling movement of the blade between the cutting and retracted positions with an actuator connected between the frame, through at least one link arm, and the blade; controlling an adjustment of a cutting depth of the blade relative to the bulk roll of material with core using an adjustment device connected between the at least one link arm and the frame; and preventing an inadvertent gravitational fall of the blade with a safety linkage connected between the at least one link arm and the frame.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Within the industry, various devices have been produced to cut the residual layers off a core of a bulk roll. In general, these machines allow for fast and efficient removal of the residual layers as compared to unrolling the residual layers off the core. In operation, these machines typically hold the bulk roll in a stationary position on an arbor or mandrel and move a cutting blade or knife through the residual layers of the paper.

Figure 1:
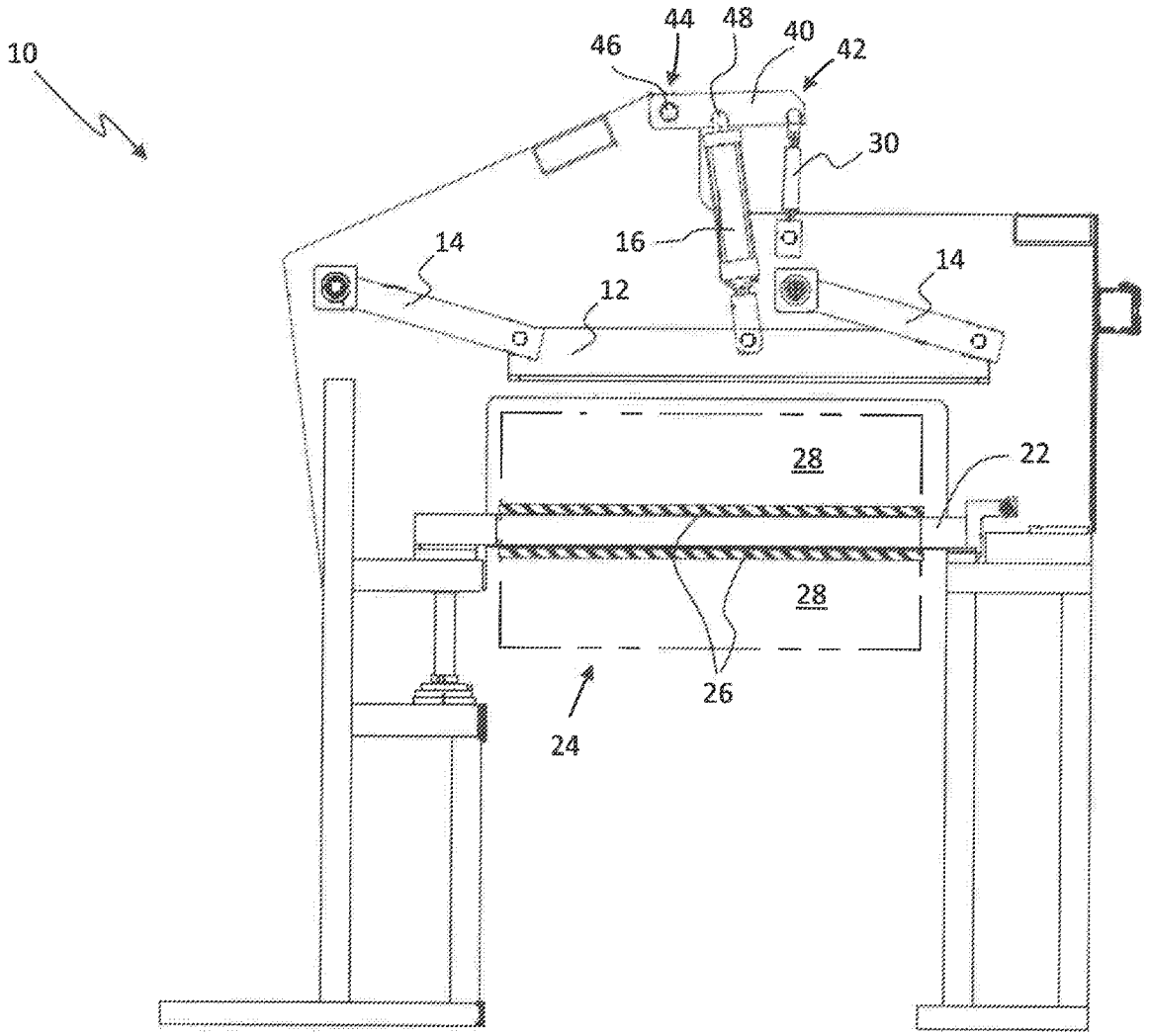
FIGS. 1-2 are front, partial cross-sectional view illustrations of a bulk roll cutting device with the hydraulic-actuated swing arm blade.
Figure 2:
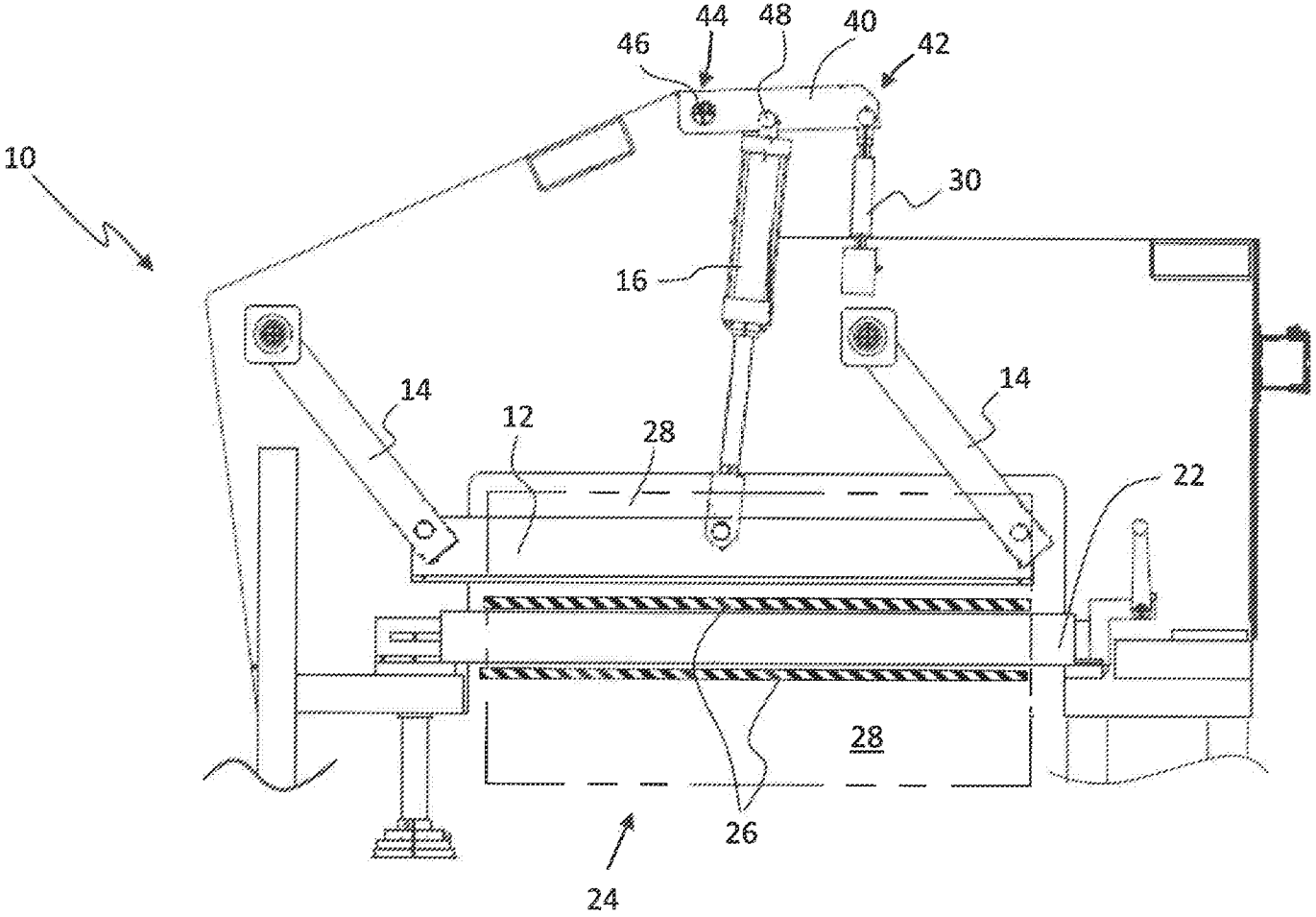

One particular type of machine for removing these residual layers of paper from the core of a bulk roll is a bulk roll cutting machine which uses a hydraulic-actuated swing arm blade. FIGS. 1-2 are front view, partial cross-sectional illustrations of a bulk roll cutting device 10 with the hydraulic-actuated swing arm blade. As shown in FIGS. 1-2, the bulk roll cutting device 10 has a blade 12 which is carried on two swing arms 14. One end of each of the swing arms 14 is pivotally affixed to the blade 12 and the other end of each of the swing arms 14 is connected to a frame of the bulk roll cutting device 10. The blade 12 is moved via actuation of an actuator 16, such as a hydraulic piston, which is connected between the blade 12 and link arm 40 positioned towards the top of the bulk roll cutting device 10. Beyond a hydraulic piston, the actuator 16 may include other suitable devices for moving the blade 12, such as a pneumatic actuator or a motorized actuator. On the lower end of the bulk roll cutting device 10, an arbor 22 or mandrel is positioned substantially parallel to the blade 12. On the arbor 22, a bulk roll 24 can be placed such that the core 26 of the bulk roll and the residual layers of paper 28 (shown over-exaggerated for clarity in disclosure) are positioned substantially parallel to the blade 12 as well. During operation of the bulk roll cutting device 10, the arbor 22 may be retained stationary until a cutting operation is finished at which point the arbor 22 may be movable to allow removal of the core 26 and placement of the next bulk roll 24 to be cut.

The cutting action of the blade 12 may be achieved through actuation of the actuator 16, which causes the actuator 16 to extend, thereby rotating the swing arms 14 about the pivot points attached to the frame of the bulk roll cutting device 10. This movement causes the blade 12 to lower towards the bulk roll 24 with a lateral swing or guillotine cutting action, e.g., where the blade 12 is moved in both vertical and horizontal directions simultaneously. Movement of the blade 12 in this fashion may provide the desired cutting effect on the residual layers of paper 28 on the bulk roll 24, in that, the combination of horizontal and vertical movement may create a shear slicing effect on the residual layers of paper 28 which may prove to be more desirable than only a vertical movement (chopping effect). However, various devices may be configured to perform different cutting actions, all of which are considered within the scope of the present disclosure.

To ensure successful operation of the bulk roll cutting device 10, the blade 12 must achieve the precise cutting position required for the residual layers of paper 28 on the bulk roll 24 to be fully removed from the core 26, but for the core 26 itself to be left intact so it can be reused. In other words, the blade 12 must descend far enough into the bulk roll 24 to fully cut through the residual layers of paper 28, or substantially all of the residual layers of paper 28, yet not descend so far that the cutting edge of the blade 12 cuts into the core 26 substantially enough to cause damage to it. To ensure the blade 12 achieves this position during the cutting action, the bulk roll cutting device 10 must be configured or adjusted for each bulk roll 24 having a differently sized core 26 needing to be processed.

In practice, prior to processing a bulk roll 24 or a plurality of bulk rolls 24 having the same core 26 size, the operator of the bulk roll cutting device 10 must go through the blade adjustment procedure to adjust the cutting depth of the blade 12. A common blade adjustment procedure includes the operator first moving the blade 12 to a down position, e.g., the bottom stroke or cutting position, when the arbor 22 of the bulk roll cutting device 10 is free from a bulk roll 24. The down position of the blade 12 is illustrated in FIG. 2 while the up or non-cutting position is shown in FIG. 1. The operator can then swing the arbor 22 outwards and place a blank core 26 on the arbor 22. The arbor 22 is swung back to the operational position such that the core 26 positioned on the arbor 22 is located below and parallel with the blade 12. The operator then can adjust an adjustment device 30, positioned near the top of the bulk roll cutting device 10, which allows a link arm 40, on which the actuator 16 is mounted, to be adjusted relative to the arbor 22. As described in further detail relative to FIGS. 3-5, the adjustment device 30 includes opposing threaded inserts which threadedly connect to a central rotatable body, whereby rotation of the body relative to the inserts causes the inserts to move closer together or further apart from one another along an axial direction.

In particular, adjusting the adjustment device 30 will either raise or lower the distal end 42 of the link arm 40, causing the link arm 40 to rotate about a pivot point 46 at its proximate end 44, in turn, raising or lowering the piston attachment point 48. Raising or lowering the piston attachment point 48 on the link arm 40 adjusts the reach of the actuator 16 relative to the arbor 22 and therefore can be used to adjust the relative position or distance of the blade 12 attached to the actuator 16 to the arbor 22 to configure the cutting depth. Accordingly, with the blade 12 in the down position, the operator can adjust the adjustment device 30 until the desired cutting depth is achieved, which may include the cutting edge of the blade 12 being positioned in contact with the blank core 26 or substantially in contact with the blank core 26 (such that the cutting edge of the blade 12 is positioned within a minimal predetermined distance to the outer surface of the core 26). The exact cutting depth selected may vary depending on the type of core 26, the size of the core 26, the type of residual material to be cut off the core 26, or other factors, such as the preciseness of cut desired by the operator.

One concern with adjusting the bulk roll cutting device 10 to have the desired cutting depth is with operator error, or more particularly, with operators failing to follow the proper adjustment procedures. The cutting depth may need to be adjusted for each differently sized core 26, such that it may be common for the bulk roll cutting device 10 to be adjusted frequently. Instead of adjusting the blade cutting depth with a blank core when the blade 12 is in the down position, noted above as the proper procedure, some operators may cut corners and choose to adjust the adjustment device 30 while the blade 12 is raised. This creates a situation where the adjustment device 30 can be adjusted beyond optimal and safe positions. For example, the operator may lengthen the adjustment device 30 too far which may allow one or both of the threaded inserts to become removed or separated from the central rotatable body, which can allow the link arm 40 to swing downwards about the pivot point 46, thereby effectively allowing the blade 12 to drop down to the arbor 22. In another example, the operator may shorten the adjustment device 30 too much such that the link arm 40 can swing downwards about the pivot point 46 and drop the blade 12 on to the arbor 22. These situations can create hazardous conditions for the operator or any other personnel in the vicinity.

Figure 3:
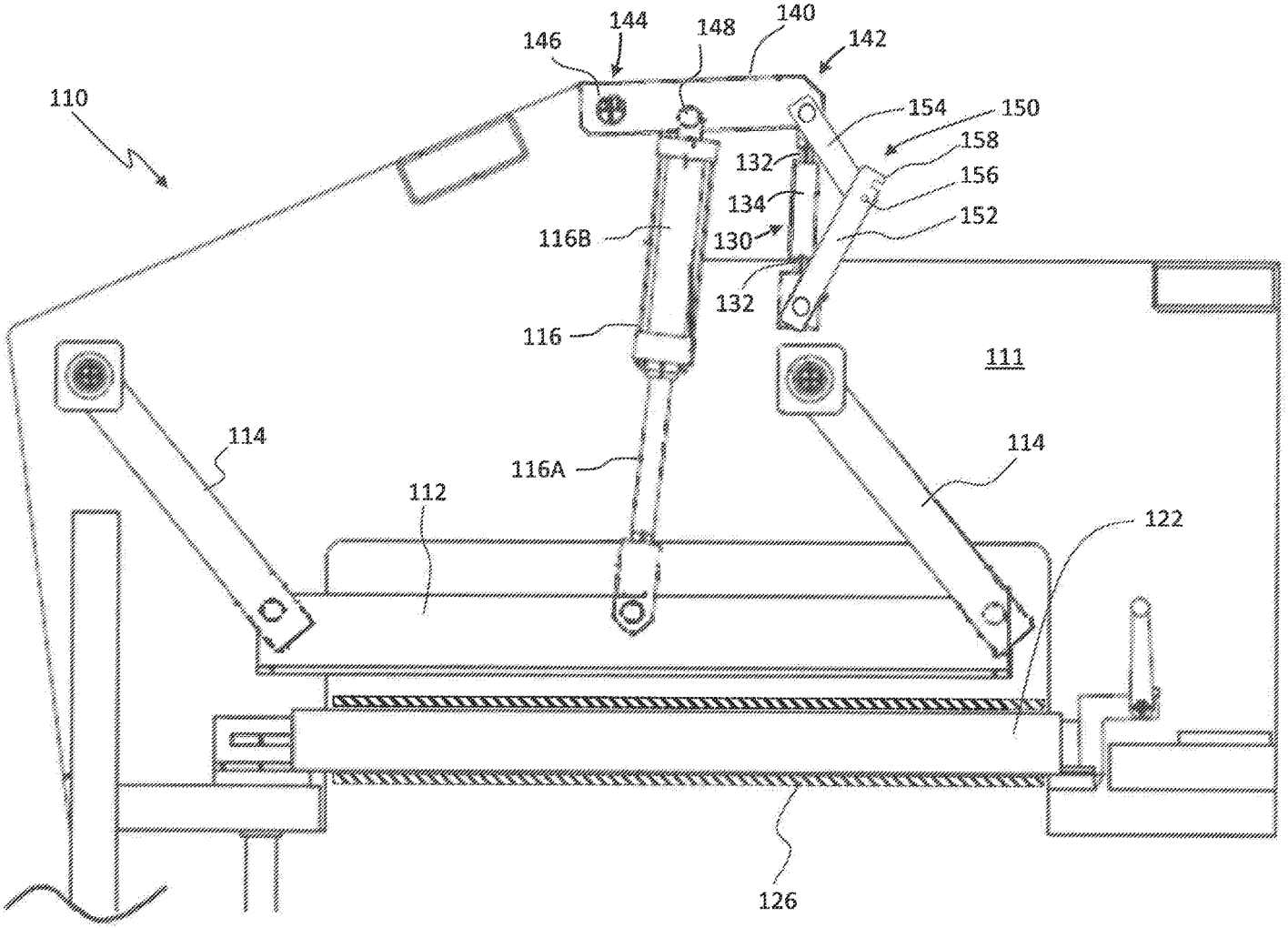
FIG. 3 is a front, partial cross-sectional view illustration of the bulk roll cutting device with the hydraulic-actuated swing arm blade and safety linkage, in accordance with a first exemplary embodiment of the present disclosure.

To prevent these hazards, a bulk roll cutting device 110 with the hydraulic-actuated swing arm blade can include a safety linkage. FIG. 3 is a front view illustration of the bulk roll cutting device 110 with the hydraulic-actuated swing arm blade and safety linkage, in accordance with a first exemplary embodiment of the present disclosure. As shown, the bulk roll cutting device 110, hereinafter referred to as 'device 110' includes many of the same components of the bulk roll cutting device 10 of FIGS. 1-2, including a blade 112 which is carried on two swing arms 114. One end of each of the swing arms 114 is pivotally affixed to the blade 112 and the other end of each of the swing arms 114 is connected to a frame 111 of the device 110, which may be understood to include connections to other structures which are directly or indirectly connected to the frame 111 of the device 110 or another substantially stationary structure. The blade 112 is moved via actuation of an actuator, such as a hydraulic piston 116 having a piston rod 116A and a hydraulic cylinder 116B. The hydraulic piston 116 is connected between the blade 112 and a link arm 140 positioned towards the top of the device 110. Other actuators, such as pneumatic actuators, motorized actuators, or the like may also be used.

On the lower end of the device 110, an arbor 122 or mandrel is positioned substantially parallel to the blade 112. A bulk roll can be placed on the arbor 122 such that the core 126 of the bulk roll and the residual layers of paper are positioned substantially parallel to the blade 112. The device 110 further includes an adjustment device 130 which can either raise or lower the distal end 142 of the link arm 140. The adjustment device 130 includes opposing threaded inserts 132 which threadedly connect to a central rotatable body 134, whereby rotation of the body 134 relative to the inserts 132 causes the inserts 132 to move closer together or further apart from one another along an axial direction. Adjustment of the adjustment device 130 causes the link arm 140 to rotate about a pivot point 146 at its proximate end 144, in turn, raising or lowering the piston attachment point 148. Raising or lowering the piston attachment point 148 on the link arm 140 adjusts the reach of the hydraulic piston 116 relative to the arbor 122 and therefore can be used to adjust the relative position or distance of the blade 112 attached to the hydraulic piston 116 to the arbor 122 to configure the cutting depth.

A safety linkage 150 is positioned on the device 110 in a location connecting the distal end 142 of the link arm 140 to the frame 111 of the device 110, and in particular, the frame 111 of the device 110 at the location where the adjustment device 130 connects to the frame 111, or at another location on the frame 111. Accordingly, in one example, the safety linkage 150 may be connected to the point on the frame 111 and the link arm 140 where the adjustment device 130 is connected. These connection points are shown in detail in FIGS. 4-5. The safety linkage 150 includes at least a first linkage member 152 and a second linkage member 154 which are connected together by a pivotal connection 156 such that each of the first and second linkage members 152, 154 can at least partially rotate about the pivotal connection 156 there between. As shown in FIG. 3, the first linkage member 152 may be connected to the frame 111 of the device 110 whereas the second linkage member 154 may be connected to the distal end 142 of the link arm 140.

At least one of the first and second linkage members 152, 154 may include a mechanical stop 158 which is positioned to make contact between the first and second linkage members 152, 154 and prevent relative movement beyond a predetermined distance. For example, in FIG. 3, the mechanical stop 158 is formed in the first linkage member 152 and will contact an edge of the second linkage member 154 when the two linkages are moving towards an aligned position, such that the mechanical stop 158 prevents two linkages from moving beyond an aligned or coaxial position, e.g., where the elongate axis of the first and second linkage members 152, 154 are substantially aligned or coaxial. The mechanical stop 158 is described in detail relative to FIGS. 4-7. In operation, the safety linkage 150 acts to control a position and movement of the link arm 140 relative to the frame 111 in the event that the adjustment device 130 inadvertently fails, is inadvertently separated or disconnected, or is otherwise manipulated to the point where the link arm 140 is likely to swing downwards about the pivot point 146 allowing the hydraulic piston 116 with blade 112 to drop or inadvertently gravitationally fall towards the arbor 122.

Figure 4:
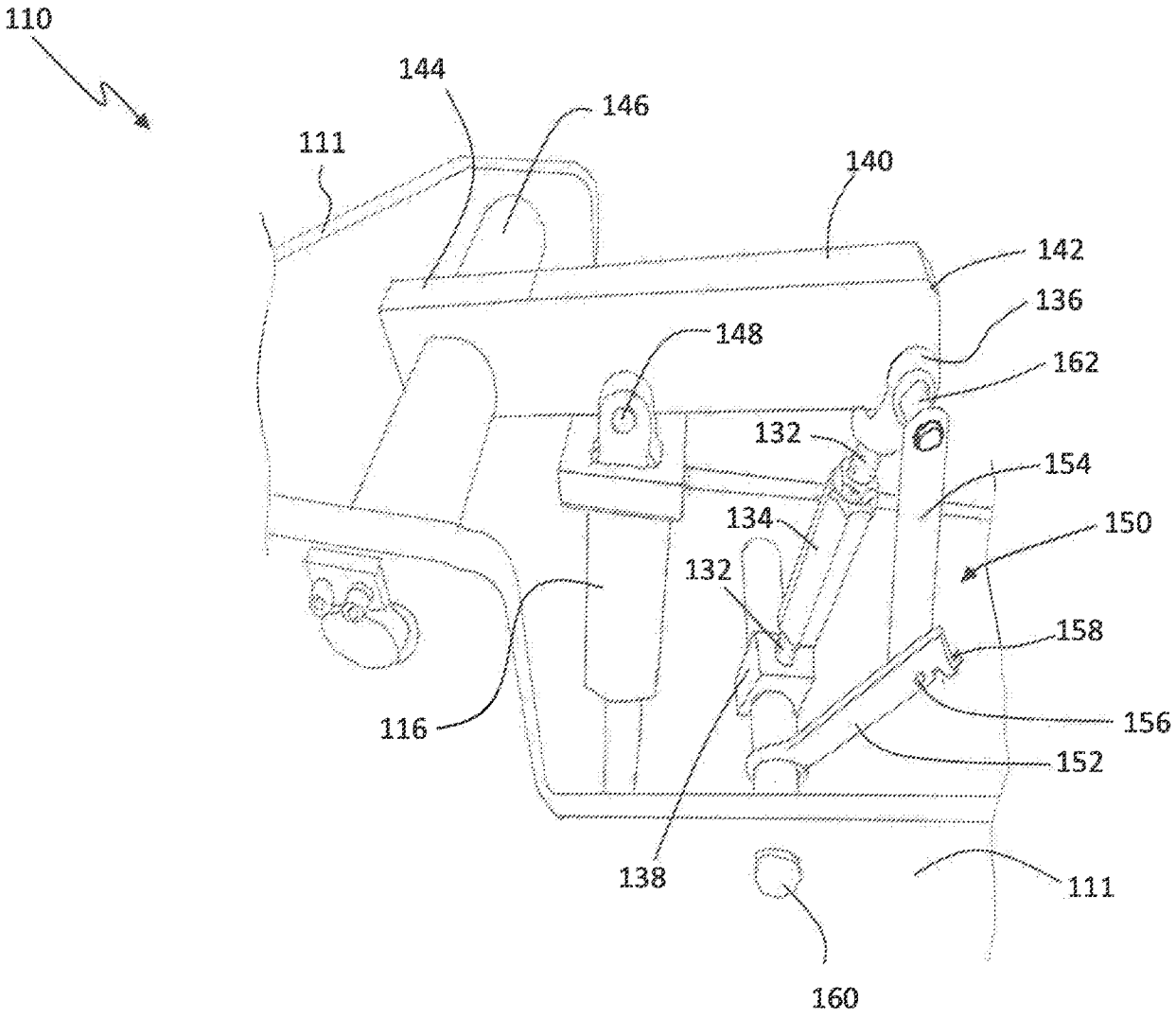
FIG. 4 is an elevated front view illustration of the bulk roll cutting device and safety linkage, in accordance with the first exemplary embodiment of the present disclosure.
Figure 5:
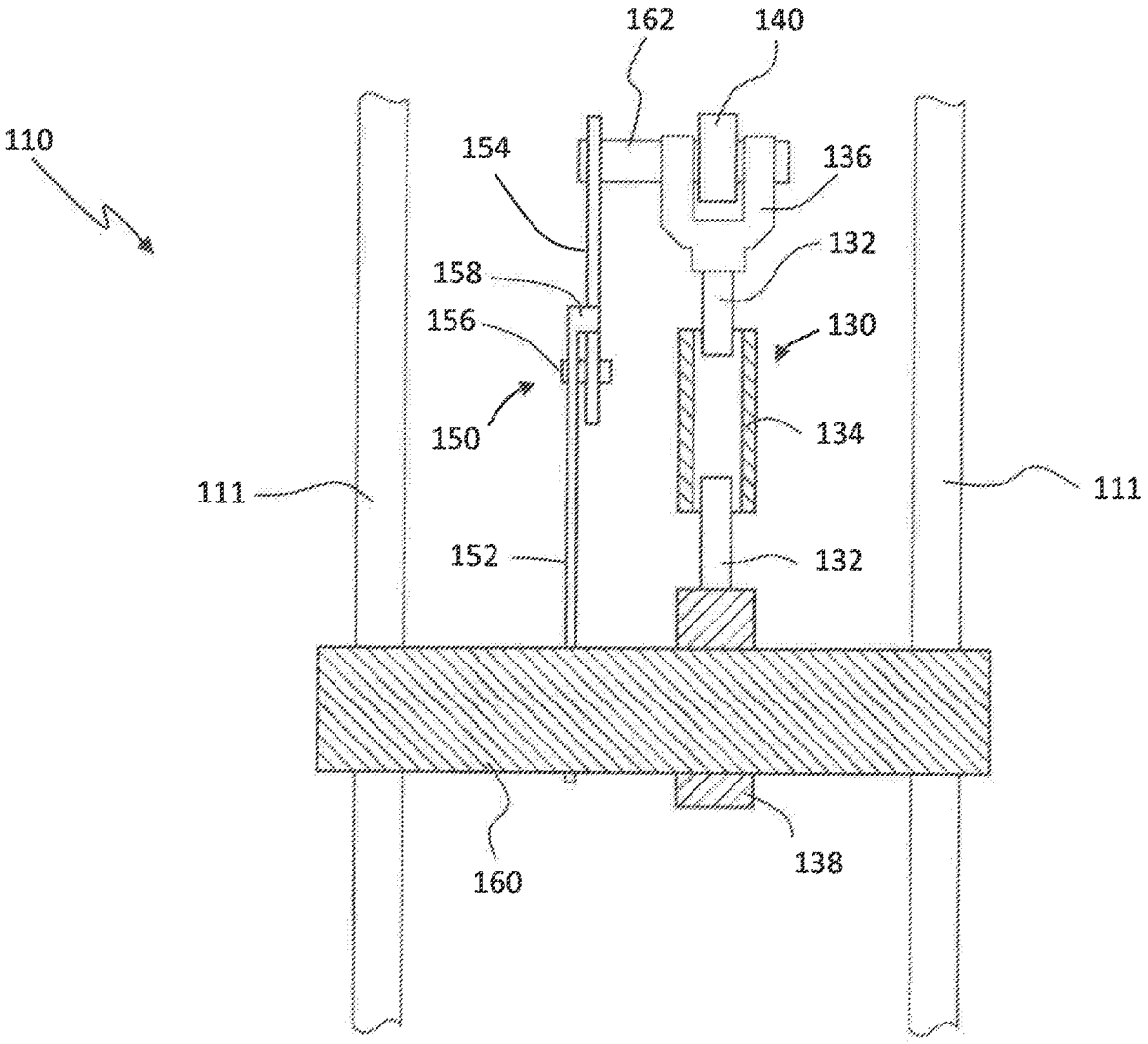
FIG. 5 is a partial cross-sectional side view illustration of the bulk roll cutting device and safety linkage, in accordance with the first exemplary embodiment of the present disclosure.

FIG. 4 is an elevated front view illustration of the bulk roll cutting device 110 and safety linkage, in accordance with the first exemplary embodiment of the present disclosure. FIG. 5 is a partial cross-sectional side view illustration of the bulk roll cutting device 110 and safety linkage, in accordance with the first exemplary embodiment of the present disclosure. The structure of the device 110 and safety linkage 150 can be seen in greater detail in FIGS. 4-5. As shown, the pivot point 146 to which the link arm 140 is connected, may include a shaft which is interconnected between opposing walls of the frame 111 of the device 110. A second shaft 160 may be positioned between the opposing walls of the frame 111 of the device 110 at a different location to support the lower end of the safety linkage 150 and the adjustment device 130. At the top end of the safety linkage 150, e.g., at a connection point between the second linkage member 154 and the link arm 140, a pin 162 may be used to provide a single point of connection between the second linkage member 154 and the adjustment device 130 with the distal end 142 of the link arm 140. The pin 162, as clearly shown in FIG. 5, may extend through the second linkage member 154 and a rod clevis 136 of the adjustment device 130. The pin 162 may be secured with various fasteners such as washers, cotter pins, and/or threaded fasteners.

In FIG. 5, the adjustment device 130 is illustrated in a partial cross-sectional view, where the connection between the two threaded inserts 132 and the threaded body 134 can be understood. Similar in operation to a turnbuckle, the body 134 of the adjustment mechanism 130 can be rotated with a suitable tool, such as an open end wrench, which causes the threaded inserts 132 to move inwards towards a center of the body 134 or outwards towards the terminating ends of the body 134, depending of course on the direction of rotation of the body 134. The top threaded insert 132 may have a clevis 136 or similar structure to connect to the pin 162 which is connected through the link arm 140 and the bottom threaded insert 132 may have a connector 138 which is positioned about the circumference of the shaft 160.

Figure 7:
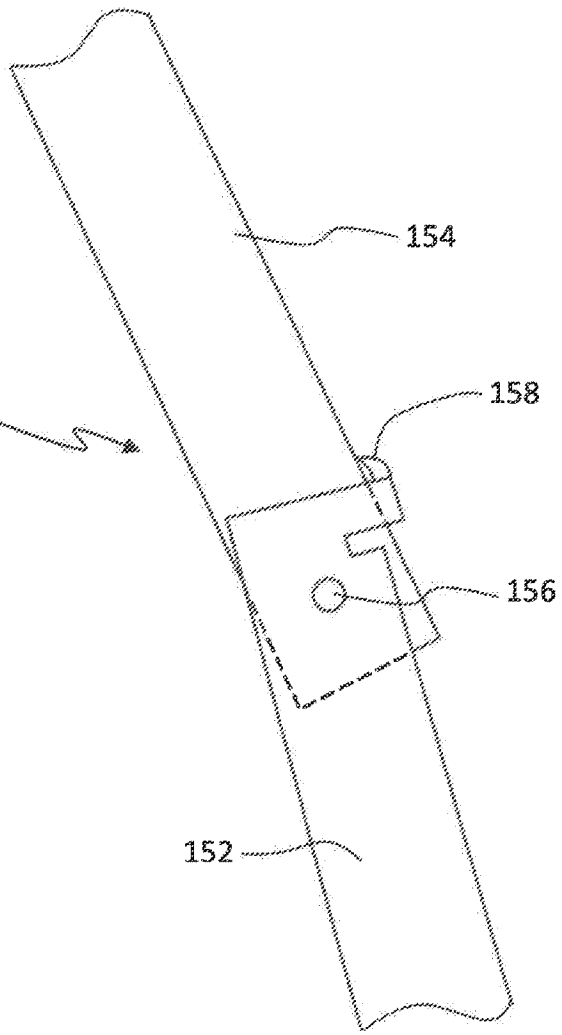
FIGS. 6-7 are front view illustrations of the safety linkage in different positions, in accordance with the first exemplary embodiment of the present disclosure.
Figure 6:
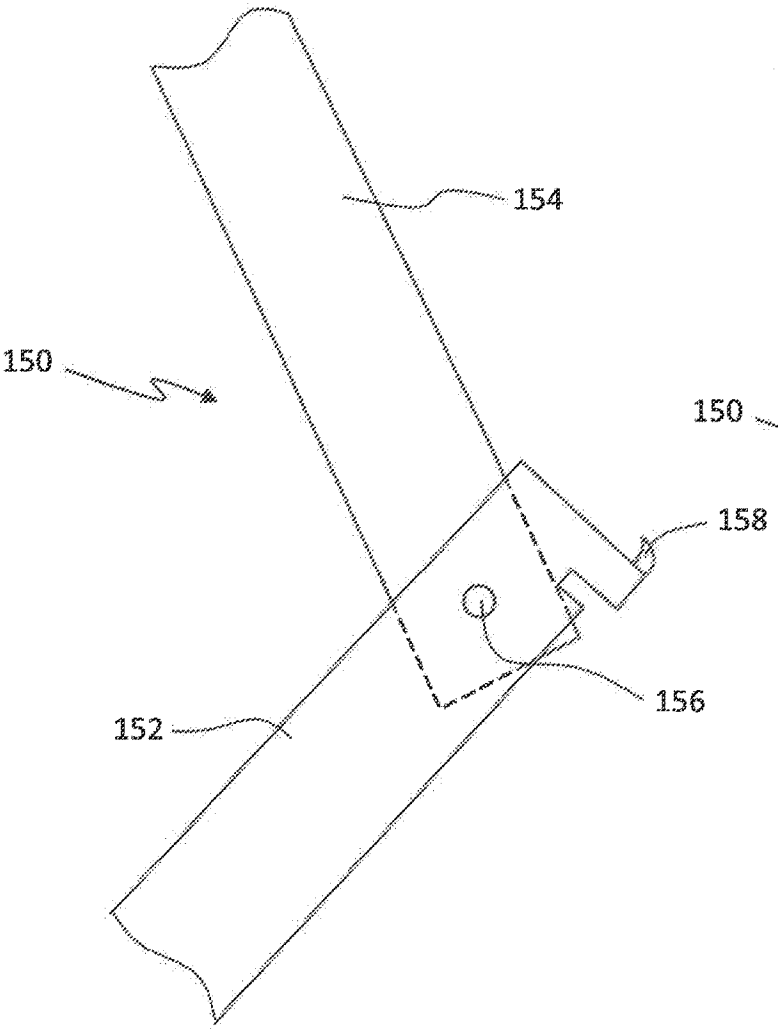

FIGS. 6-7 are front view illustrations of the safety linkage 150 in different positions, in accordance with the first exemplary embodiment of the present disclosure. With reference to FIGS. 4-7, the mechanical stop 158 of the safety linkage 150 can also be seen in detail. The mechanical stop 158 extends in a lateral direction from the back edge of the first linkage member 152 and is positioned to contact the back edge of the second linkage member 154 when the linkage members are moved to a predetermined position. FIG. 7 illustrates the mechanical stop 158 in contact with the second linkage member 154 whereas FIG. 6 illustrates the mechanical stop 158 prior to contact with the second linkage member 154. The mechanical stop 158 may be formed integrally with the metal of the first linkage member 152, such as where a portion of the metal material of the first linkage member 152 is bent or molded outside of the plane of the linkage member, or it may be formed as a separate unit, such as one which is threadedly connected to the first linkage member 152, e.g., a bolt which is positioned through the linkage member and extends laterally of the sides of the linkage member. It is noted that the mechanical stop 158 may be formed on either the first or second linkage members 152, 154, or both, depending on the design and intended use of the device 110. All variations are considered within the scope of the present disclosure.

Figure 8:
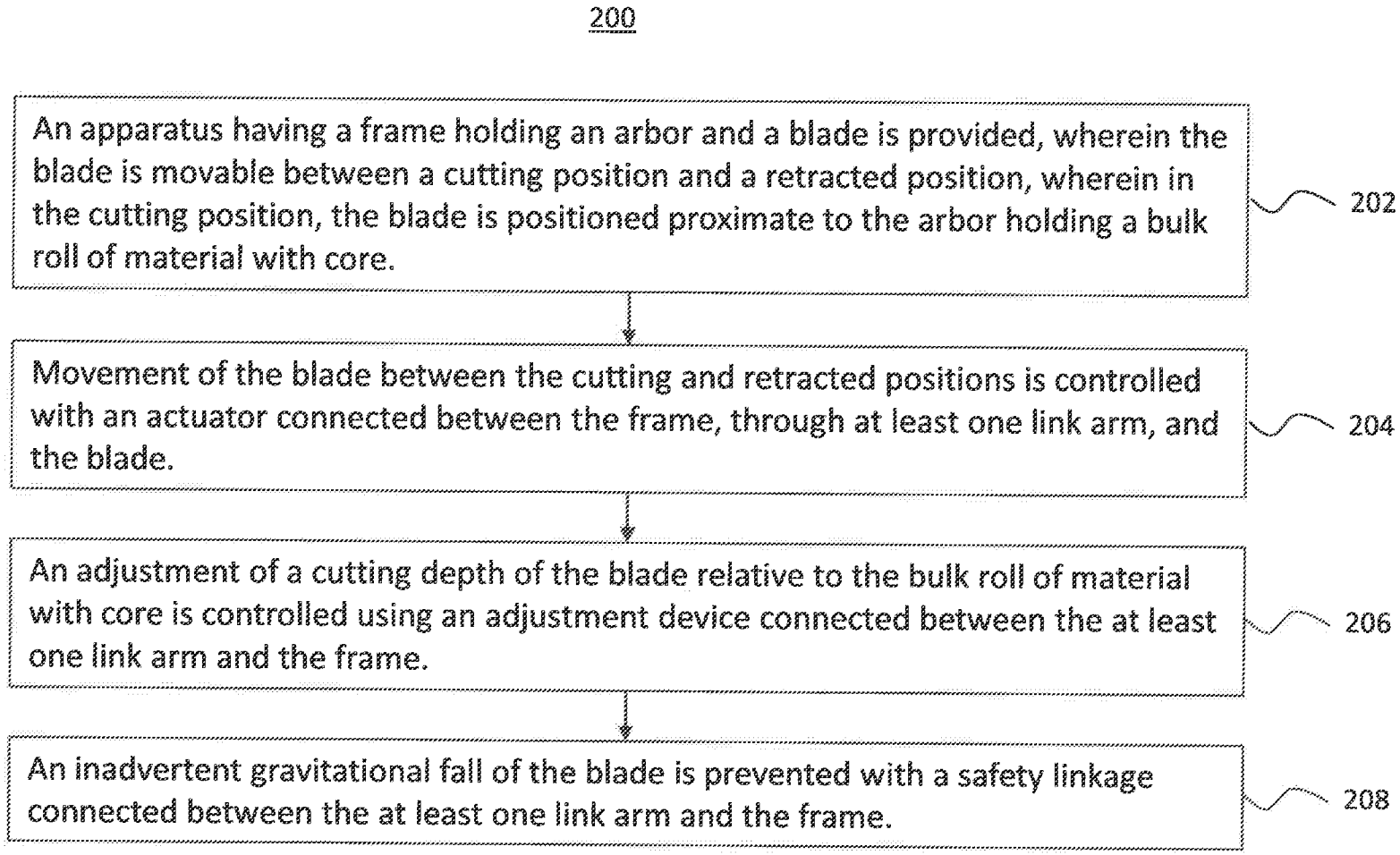
FIG. 8 is a flowchart illustrating a method of preventing inadvertent gravitational falls of a blade of an apparatus for removing bulk rolled material from a core, in accordance with a second exemplary embodiment of the disclosure.

FIG. 8 is a flowchart 200 illustrating a method of preventing inadvertent gravitational falls of a blade of an apparatus for removing bulk rolled material from a core, in accordance with a second exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, an apparatus having a frame holding an arbor and a blade is provided, wherein the blade is movable between a cutting position and a retracted position, wherein in the cutting position, the blade is positioned proximate to the arbor holding a bulk roll of material with core. Movement of the blade between the cutting and retracted positions is controlled with an actuator connected between the frame, through at least one link arm, and the blade (block 204). An adjustment of a cutting depth of the blade relative to the bulk roll of material with core is controlled using an adjustment device connected between the at least one link arm and the frame (block 206). An inadvertent gravitational fall of the blade is prevented with a safety linkage connected between the at least one link arm and the frame (block 208). Any number of additional steps, functions, processes, or variants thereof may be included in the method, including any disclosed relative to any other figure of this disclosure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claim.

What is claimed is:

1. A bulk roll cutting apparatus with a safety linkage, the apparatus comprising:

a frame;

at least one swing arm having one end connected to the frame and another end connected to a swing blade, wherein the swing blade is movable between a cutting position and a retracted position, wherein in the cutting position, the swing blade is positioned proximate to an arbor;

at least one link arm movably connected to the frame at a proximate end of the at least one link arm, wherein the at least one link arm is positioned above the at least one swing arm;

an actuator having one end connected to the at least one link arm and another end connected to the swing blade;

an adjustment device connected to a distal end of the at least one link arm and the frame, the adjustment device controlling a height of the distal end of the at least one link arm, thereby controlling a cutting depth of the swing blade relative to the arbor; and the safety linkage connected to the distal end of at least one link arm and the frame, the safety linkage preventing an inadvertent gravitational fall of the swing blade, wherein the safety linkage comprises first and second linkage members connected with a pivotal connection therebetween.

2. The apparatus of claim 1, wherein the safety linkage and the adjustment device are connected to the at least one link arm at the same location on the at least one link arm.

3. The apparatus of claim 1, wherein the safety linkage and adjustment device are connected to the frame at the same location on the frame.

4. The apparatus of claim 1, further comprising a mechanical stop positioned on at least one of the first or second linkage members, wherein the mechanical stop prevents the first and second linkage members from moving beyond an aligned or coaxial position.

5. The apparatus of claim 4, wherein the pivotal connection is positioned between the mechanical stop and a connection point where the safety linkage connects to the at least one link arm or the frame.

6. The apparatus of claim 1, wherein the safety linkage is connected to the frame through a shaft, wherein the shaft is positioned between two opposing frame walls.

7. The apparatus of claim 1, wherein the at least one link arm is movably connected to the frame at a first end of the at least one link arm, wherein the actuator is connected to the at least one link arm at a middle portion of the at least one link arm, and wherein the adjustment device and the safety linkage are connected to the at least one link arm at a second end of the at least one link arm, wherein the middle portion is positioned between the first and second ends.

8. An apparatus for removing bulk rolled material from a core, the apparatus comprising:

a frame having two frame walls, the frame supporting a swing blade movable between a cutting position and a retracted position, wherein in the cutting position, the blade is positioned proximate to an arbor capable of holding a bulk roll;

at least one link arm movably connected to the frame through a first shaft extending between the two frame walls, whereby the at least one link arm is positioned at least partially in a space formed between the two frame walls;

an actuator having one end connected to the at least one link arm and another end connected to the blade, the actuator at least partially positioned in the space formed between the two frame walls;

an adjustment device connected to the at least one link arm and the frame through a second shaft, the adjustment device being adjustable to control a cutting depth of the blade relative to the arbor; and a safety linkage connected to the at least one link arm and the frame through the second shaft, the safety linkage preventing an inadvertent gravitational fall of the blade, wherein the safety linkage comprises first and second linkage members connected with a pivotal connection therebetween.

9. The apparatus of claim 8, wherein the safety linkage and the adjustment device are connected to the at least one link arm at the same location on the at least one link arm.

10. The apparatus of claim 9, further comprising a mechanical stop positioned on at least one of the first or second linkage members, wherein the mechanical stop prevents the first and second linkage members from moving beyond an aligned or coaxial position.

11. The apparatus of claim 10, wherein the pivotal connection is positioned between the mechanical stop and a connection point where the safety linkage connects to the at least one link arm or the second shaft.

12. The apparatus of claim 8, wherein the at least one link arm is movably connected to the first shaft at a first end of the at least link arm, wherein the actuator is connected to the at least one link arm at a middle portion of the at least one link arm, and wherein the adjustment device and the safety linkage are connected to the at least one link arm at a second end of the at least one link arm, wherein the middle portion is positioned between the first and second ends.

* * * * *